US010653245B2

(12) United States Patent
Zhang et al.

(10) Patent No.: US 10,653,245 B2
(45) Date of Patent: May 19, 2020

(54) POWER OPERATION SYSTEM AND CHAIR HAVING SAME

(71) Applicant: Shanghai Sterling Motion Technology Co., Ltd., Shanghai (CN)

(72) Inventors: Yanjun Zhang, Shanghai (CN); Liang Huang, Shanghai (CN)

(73) Assignee: SHANGHAI STERLING MOTION TECHNOLOGY CO., LTD., Shanghai (CN)

( * ) Notice: Subject to any disclaimer, the term of this patent is extended or adjusted under 35 U.S.C. 154(b) by 55 days.

(21) Appl. No.: 16/208,816

(22) Filed: Dec. 4, 2018

(65) Prior Publication Data

US 2019/0191883 A1 Jun. 27, 2019

Related U.S. Application Data

(60) Provisional application No. 62/610,109, filed on Dec. 22, 2017.

(51) Int. Cl.
*A47C 7/46* (2006.01)
*A47C 7/38* (2006.01)

(52) U.S. Cl.
CPC ..... *A47C 7/462* (2013.01); *A47C 7/38* (2013.01)

(58) Field of Classification Search
None
See application file for complete search history.

(56) References Cited

U.S. PATENT DOCUMENTS 4,714,291 A * 12/1987 Hattori ..... A47C 7/462 297/204
5,078,449 A * 1/1992 Suzuki ..... A47C 7/462 297/284.4
8,042,415 B2 * 10/2011 Ito ..... B60N 2/0232 74/89.23
2005/0062330 A1 * 3/2005 Eberle ..... B60N 2/4228 297/408
2009/0079245 A1 * 3/2009 Marcantoni ..... A47C 7/465 297/284.4
2012/0086256 A1 * 4/2012 Adams ..... A47C 7/38 297/408
2016/0227933 A1 * 8/2016 Donovan ..... A47C 1/02
2016/0345740 A1 * 12/2016 Lu ..... A47C 7/38
(Continued)

*Primary Examiner* — David E Allred
(74) *Attorney, Agent, or Firm* — Locke Lord LLP; Tim Tingkang Xia, Esq.

(57) ABSTRACT

A power operation system used in a chair includes a power operation system. The power operation system includes a power headrest operation system, including: a headrest board; a pair of headrest posts; a pair of headrest support posts; a headrest axis of rotation; a first mounting bracket and a second mounting bracket; a headrest actuator; a first pulling mechanism; and a first stopping mechanism. When the headrest actuator drives in the headrest forward direction, the headrest actuator rotates, through rotation of the headrest axis of rotation, the headrest board from a closed headrest position to an open headrest position. When the headrest actuator drives in the headrest backward direction, the first pulling mechanism pulls the headrest board from the open headrest position to the closed headrest position, the first stopping mechanism prevents the headrest board from rotating any further once the headrest board arrives at the closed headrest position.

17 Claims, 15 Drawing Sheets

(56) References Cited

U.S. PATENT DOCUMENTS

| | | | | |
|---|---|---|---|---|
| 2016/0367033 | A1* | 12/2016 | Sigmon | A47C 1/02 |
| 2017/0215590 | A1* | 8/2017 | Sigmon | A47C 7/462 |
| 2017/0360201 | A1* | 12/2017 | Brown | A47C 1/0242 |
| 2018/0125247 | A1* | 5/2018 | Li | A47C 1/0242 |
| 2018/0235370 | A1* | 8/2018 | Donovan | A47C 7/462 |
| 2019/0118687 | A1* | 4/2019 | Jeong | B60N 2/85 |
| 2019/0167004 | A1* | 6/2019 | Gu | A47C 7/38 |
| 2020/0054140 | A1* | 2/2020 | Fei | A47C 7/38 |

* cited by examiner

POWER OPERATION SYSTEM AND CHAIR HAVING SAME

CROSS-REFERENCE TO RELATED PATENT APPLICATION

This application claims priority to and the benefit of, pursuant to 35 U.S.C. § 119(e), U.S. provisional patent application Ser. No. 62/610,109, filed Dec. 22, 2017, which is incorporated herein in its entirety by reference.

FIELD OF THE INVENTION

The invention generally relates to a chair, and more particular to a power operation system with a power headrest operation system and a power lumbar operation system and a chair having the same.

BACKGROUND OF THE INVENTION

Chairs find widespread use. Nowadays people sit in chairs for a long time every day, necks and waists are prone to discomfort, and spinal diseases are becoming more and more common. Chairs with headrests and lumbar support are desirable.

Recently, electric motors have been applied to chairs to facilitate the movement through the different positions. For such a design, however, there is a risk of pinch. Moreover, the electric motors are hard to assemble.

Therefore, a heretofore unaddressed need exists in the art to address the aforementioned deficiencies and inadequacies.

SUMMARY OF THE INVENTION

The invention, in one aspect, relates to a power operation system with a power headrest operation system and a power lumbar operation system and a chair having the same.

According to one aspect of the invention, a power operation system used in a chair includes a power operation system. The power operation system includes a power headrest operation system, and the power headrest operation system includes: a headrest board with two headrest board end portions; a pair of headrest posts each with two headrest post end portions, each headrest post connected, at one headrest post end portion, to one of the two headrest board end portions of the headrest board respectively; a pair of headrest support posts each with two headrest support post end portions, each headrest support post coupled, at one headrest support post end portion, to one of the pair of headrest posts respectively; a headrest axis of rotation with two headrest rotation axis end portions, the other headrest support post end portion of each of the pair of headrest support post welded on each of the two headrest rotation axis end portions respectively; a first mounting bracket and a second mounting bracket, the headrest axis of rotation pivotally coupled to a back frame of the chair through the first mounting bracket and the second mounting bracket; a headrest actuator, the headrest actuator having two headrest actuator end portions, one headrest actuator end portion pivotally coupled to the headrest axis of rotation, the other headrest actuator end portion coupled to the first mounting bracket or pivotally coupled to a lumbar axis of rotation, the headrest actuator driving in a headrest forward direction and a headrest backward direction; a first pulling mechanism, coupled to at least one of the first mounting bracket and the second mounting bracket, and coupled to at least one of the pair of headrest support posts; and a first stopping mechanism. When the headrest actuator drives in the headrest forward direction, the headrest actuator rotates, through rotation of the headrest axis of rotation, the headrest board from a closed headrest position to an open headrest position. When the headrest actuator drives in the headrest backward direction, the first pulling mechanism pulls the headrest board from the open headrest position to the closed headrest position, the first stopping mechanism prevents the headrest board from rotating any further once the headrest board arrives at the closed headrest position.

In some embodiments, the headrest actuator includes a first spindle nut; and a first pressure lever welded on the headrest axis of rotation. When the headrest actuator drives in the headrest forward direction, the first spindle nut moves forward to push the first pressure lever, to rotate, through rotation of the headrest axis of rotation, the headrest board from the closed headrest position to the open headrest position.

In some embodiments, the headrest actuator further includes a headrest actuator housing holding the first spindle nut and the first pressure lever; and a first locking cap, snapped in the headrest actuator housing. The first locking cap and the headrest actuator housing together pivotally couple one headrest actuator end portion to the headrest axis of rotation.

In some embodiments, the first pulling mechanism is a first pair of springs, each of the first pair of springs having two ends. One end is coupled to one of the pair of headrest support posts respectively, and the other end is coupled to the first mounting bracket and the second mounting bracket respectively.

In some embodiments, the first stopping mechanism is a first pair of stopping taps. Each of the first pair of stopping taps is a protruding part of one of the pair of headrest support posts respectively, contacting the first mounting bracket and the second mounting bracket respectively when the headrest board arrives at the closed headrest position.

In some embodiments, each of the pair of headrest posts has a plurality of adjustable holes, for adjusting a relative position between each of the pair of headrest posts and each of the pair of headrest support posts.

In some embodiments, the power operation system further includes a power lumbar operation system. The power lumbar operation system includes a lumbar board with two lumbar board end portions; a pair of lumbar support posts each with two lumbar support post end portions, each lumbar support post connected, at one lumbar support post end portion, to one of the two lumbar board end portions of the lumbar board respectively; the lumbar axis of rotation with two lumbar rotation axis end portions, the other lumbar support post end portion of each of the pair of lumbar support post welded on each of the two lumbar rotation axis end portions respectively, the lumbar axis of rotation pivotally coupled to the back frame of the chair through the first mounting bracket and the second mounting bracket; a lumbar actuator, the lumbar actuator having two lumbar actuator end portions, one lumbar actuator end portion pivotally coupled to the lumbar axis of rotation, the other lumbar actuator end portion coupled to the second mounting bracket or pivotally coupled to the headrest axis of rotation, the lumbar actuator driving in a lumbar forward direction and a lumbar backward direction; a second pulling mechanism, coupled to at least one of the first mounting bracket and the second mounting bracket, and coupled to at least one of the pair of lumbar support posts; and a second stopping mechanism. When the lumbar actuator drives in the lumbar forward direction, the lumbar actuator rotates, through rotation of the lumbar axis of rotation, the lumbar board from a closed lumbar position to an open lumbar position. When the lumbar actuator drives in the lumbar backward direction, the second pulling mechanism pulls the lumbar board from the open lumbar position to the closed lumbar position, the second stopping mechanism prevents the lumbar board from rotating any further once the lumbar board arrives at the closed lumbar position.

In some embodiments, the lumbar actuator includes a second spindle nut; and a second pressure lever welded on the lumbar axis of rotation. When the lumbar actuator drives in the lumbar forward direction, the second spindle nut moves forward to push the second pressure lever, to rotate, through rotation of the lumbar axis of rotation, the lumbar board from the closed headrest position to the open headrest position.

In some embodiments, the lumbar actuator further includes a lumbar actuator housing holding the second spindle nut and the second pressure lever; and a second locking cap, snapped in the lumbar actuator housing. The second locking cap and the lumbar actuator housing together pivotally couple one lumbar actuator end portion to the lumbar axis of rotation.

In some embodiments, the second pulling mechanism is a second pair of springs, each of the second pair of springs having two ends. One end is coupled to one of the pair of lumbar support posts respectively, and the other end is coupled to the first mounting bracket and the second mounting bracket respectively.

In some embodiments, the second stopping mechanism is a second pair of stopping taps. Each of the second pair of stopping taps is a protruding part of one of the pair of lumbar support posts respectively, contacting the first mounting bracket and the second mounting bracket respectively when the lumbar board arrives at the closed lumbar position.

According to another aspect of the invention, a chair includes a back frame; and a power operation system used in the chair. The power operation system includes a power headrest operation system, and the power headrest operation system includes a headrest board with two headrest board end portions; a pair of headrest posts each with two headrest post end portions, each headrest post connected, at one headrest post end portion, to one of the two headrest board end portions of the headrest board respectively; a pair of headrest support posts each with two headrest support post end portions, each headrest support post coupled, at one headrest support post end portion, to one of the pair of headrest posts respectively; a headrest axis of rotation with two headrest rotation axis end portions, the other headrest support post end portion of each of the pair of headrest support post welded on each of the two headrest rotation axis end portions respectively; a first mounting bracket and a second mounting bracket, the headrest axis of rotation pivotally coupled to the back frame of the chair through the first mounting bracket and the second mounting bracket; a headrest actuator, the headrest actuator having two headrest actuator end portions, one headrest actuator end portion pivotally coupled to the headrest axis of rotation, the other headrest actuator end portion coupled to the first mounting bracket or pivotally coupled to a lumbar axis of rotation, the headrest actuator driving in a headrest forward direction and a headrest backward direction; a first pulling mechanism, coupled to at least one of the first mounting bracket and the second mounting bracket, and coupled to at least one of the pair of headrest support posts; and a first stopping mechanism. When the headrest actuator drives in the headrest forward direction, the headrest actuator rotates, through rotation of the headrest axis of rotation, the headrest board from a closed headrest position to an open headrest position. When the headrest actuator drives in the headrest backward direction, the first pulling mechanism pulls the headrest board from the open headrest position to the closed headrest position, the first stopping mechanism prevents the headrest board from rotating any further once the headrest board arrives at the closed headrest position.

In some embodiments, the headrest actuator includes a first spindle nut; a first pressure lever, welded on the headrest axis of rotation; a headrest actuator housing holding the first spindle nut and the first pressure lever; and a first locking cap, snapped in the headrest actuator housing. The first locking cap and the headrest actuator housing together pivotally couple one headrest actuator end portion to the headrest axis of rotation. When the headrest actuator drives in the headrest forward direction, the first spindle nut moves forward to push the first pressure lever, to rotate, through rotation of the headrest axis of rotation, the headrest board from the closed headrest position to the open headrest position.

In some embodiments, the first pulling mechanism is a first pair of springs. Each of the first pair of springs having two ends. One end is coupled to one of the pair of headrest support posts respectively, and the other end is coupled to the first mounting bracket and the second mounting bracket respectively.

In some embodiments, the first stopping mechanism is a first pair of stopping taps. Each of the first pair of stopping taps is a protruding part of one of the pair of headrest support posts respectively, contacting the first mounting bracket and the second mounting bracket respectively when the headrest board arrives at the closed headrest position.

In some embodiments, each of the pair of headrest posts has a plurality of adjustable holes, for adjusting a relative position between each of the pair of headrest posts and each of the pair of headrest support posts.

In some embodiments, the power operation system further includes a power lumbar operation system. The power lumbar operation system includes a lumbar board with two lumbar board end portions; a pair of lumbar support posts each with two lumbar support post end portions, each lumbar support post connected, at one lumbar support post end portion, to one of the two lumbar board end portions of the lumbar board respectively; the lumbar axis of rotation with two lumbar rotation axis end portions, the other lumbar support post end portion of each of the pair of lumbar support post welded on each of the two lumbar rotation axis end portions respectively, the lumbar axis of rotation pivotally coupled to the back frame of the chair through the first mounting bracket and the second mounting bracket; a lumbar actuator, the lumbar actuator having two lumbar actuator end portions, one lumbar actuator end portion pivotally coupled to the lumbar axis of rotation, the other lumbar actuator end portion coupled to the second mounting bracket or pivotally coupled to the headrest axis of rotation, the lumbar actuator driving in a lumbar forward direction and a lumbar backward direction; a second pulling mechanism, coupled to at least one of the first mounting bracket and the second mounting bracket, and coupled to at least one of the pair of lumbar support posts; and a second stopping mechanism. When the lumbar actuator drives in the lumbar forward direction, the lumbar actuator rotates, through rotation of the lumbar axis of rotation, the lumbar board from a closed lumbar position to an open lumbar position. When the lumbar actuator drives in the lumbar backward direction, the second pulling mechanism pulls the lumbar board from the open lumbar position to the closed lumbar position, the second stopping mechanism prevents the lumbar board from rotating any further once the lumbar board arrives at the closed lumbar position.

In some embodiments, the lumbar actuator includes a second spindle nut; a second pressure lever, welded on the lumbar axis of rotation; a lumbar actuator housing holding the second spindle nut and the second pressure lever; and a second locking cap, snapped in the lumbar actuator housing. The second locking cap and the lumbar actuator housing together pivotally couple one lumbar actuator end portion to the lumbar axis of rotation. When the lumbar actuator drives in the lumbar forward direction, the second spindle nut moves forward to push the second pressure lever, to rotate, through rotation of the lumbar axis of rotation, the lumbar board from the closed headrest position to the open headrest position.

In some embodiments, the second pulling mechanism is a second pair of springs. Each of the second pair of springs having two ends. One end is coupled to one of the pair of lumbar support posts respectively, and the other end is coupled to the first mounting bracket and the second mounting bracket respectively.

In some embodiments, the second stopping mechanism is a second pair of stopping taps. Each of the second pair of stopping taps is a protruding part of one of the pair of lumbar support posts respectively, contacting the first mounting bracket and the second mounting bracket respectively when the lumbar board arrives at the closed lumbar position.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
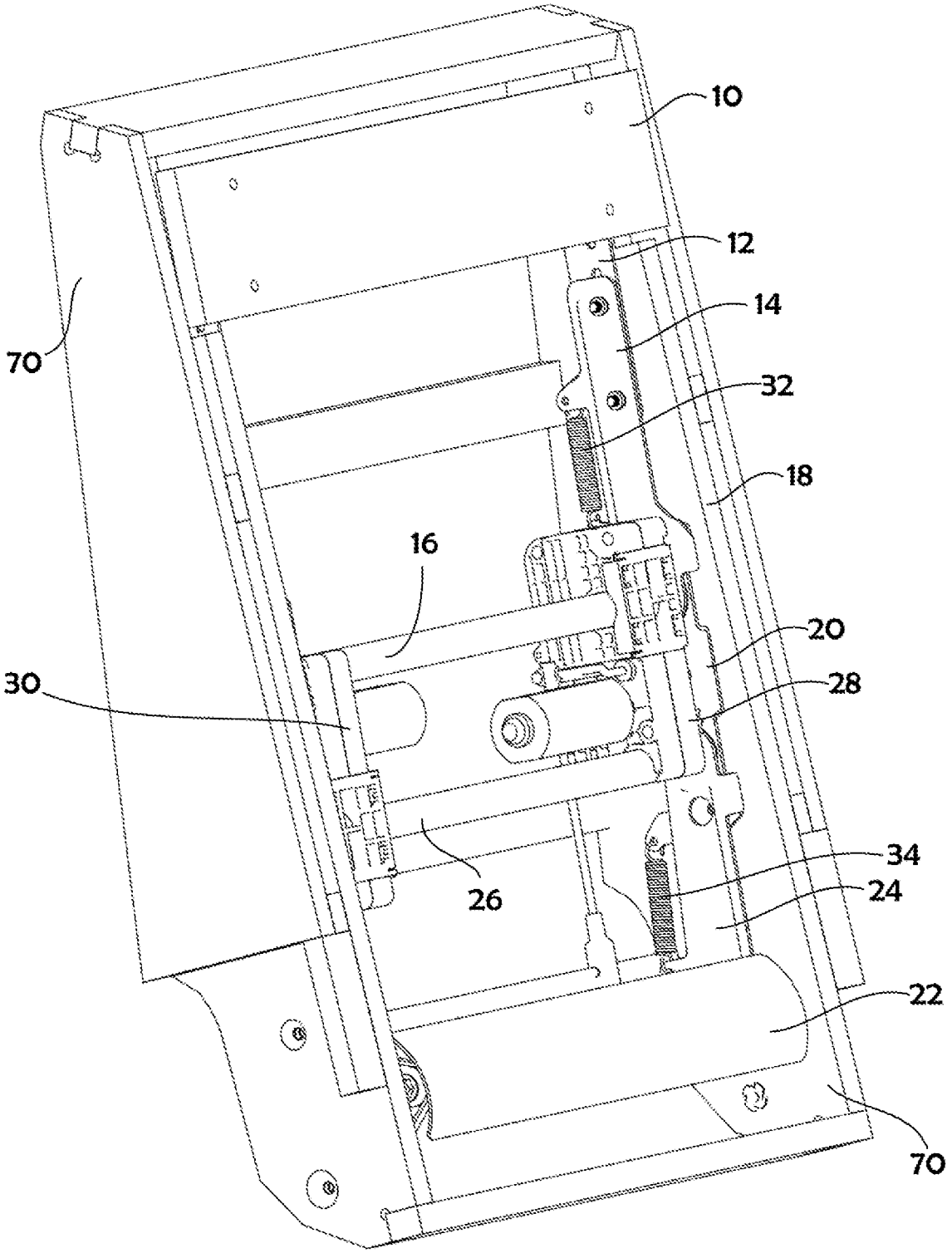
FIG. 1 shows schematically a perspective view of a chair with a power headrest operation system and a power lumbar operation system according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the invention in conjunction with the accompanying drawings in FIGS. 1-15. In accordance with the purposes of this invention, as embodied and broadly described herein, this invention, in one aspect, relates to a power operation system and a chair having the power operation system. The power operation system may include a power headrest operation system and a power lumbar operation system.

Figure 2:
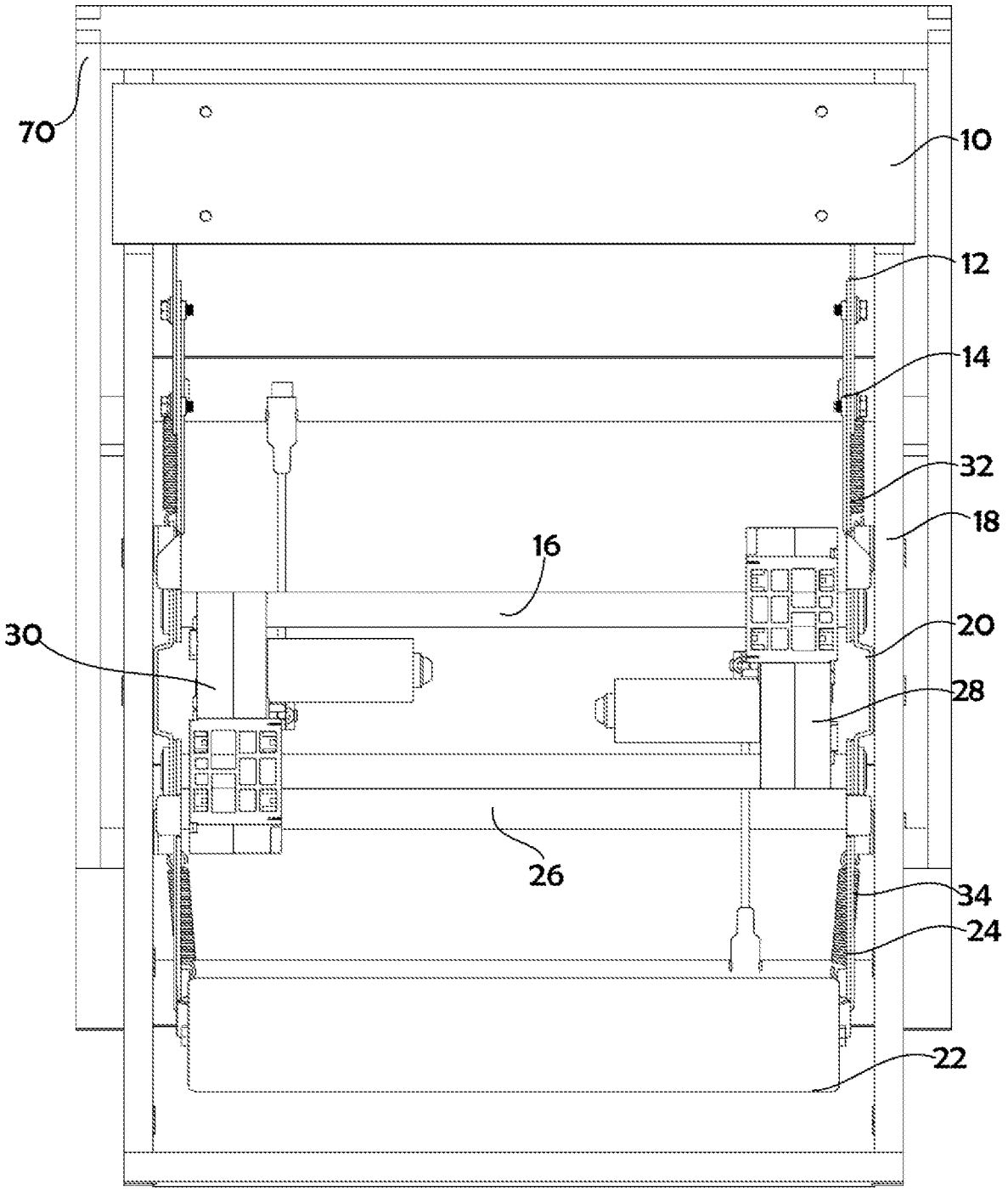
FIG. 2 shows a front elevation view of the chair shown in FIG. 1
Figure 3:
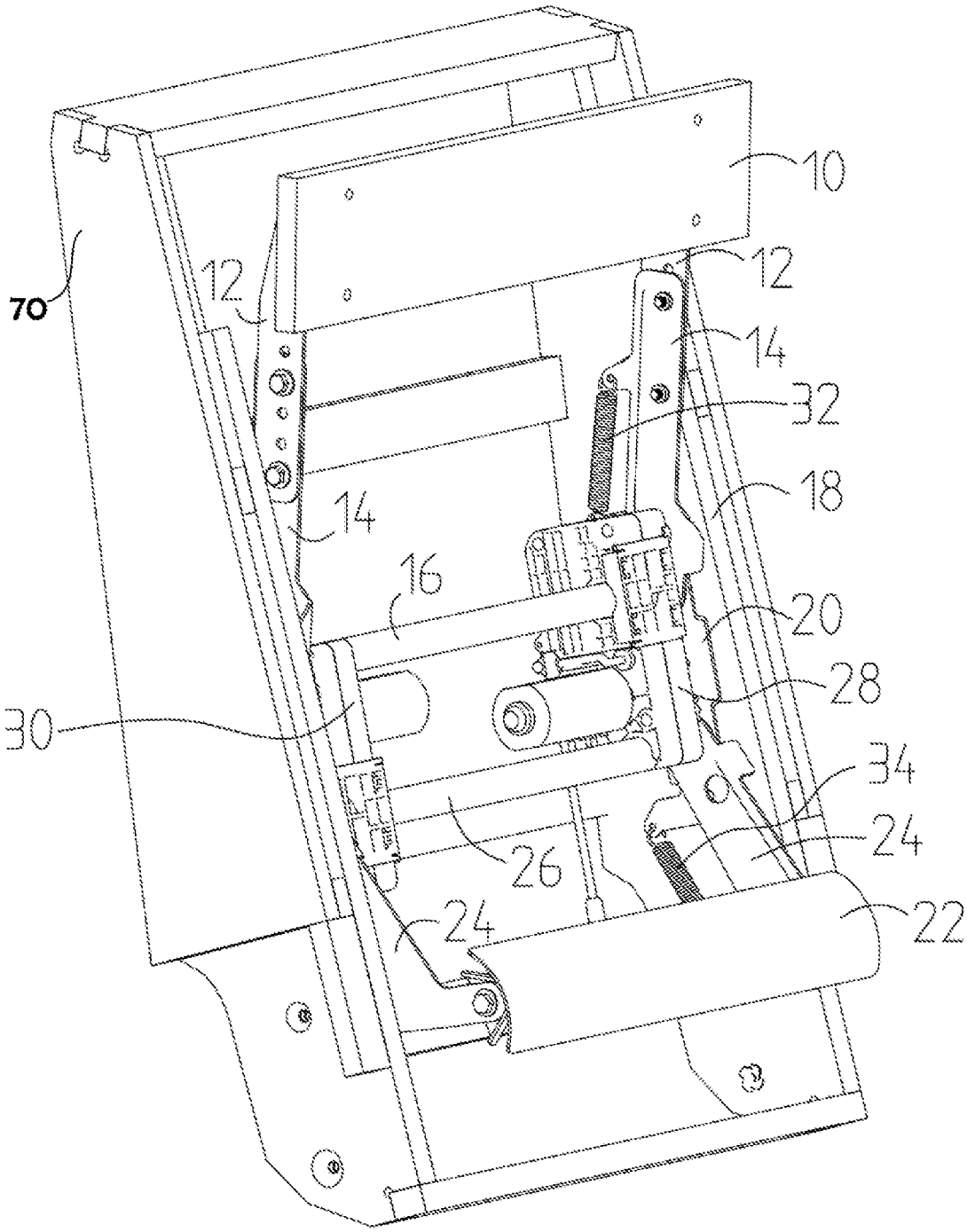
FIG. 3 shows schematically a perspective view of the chair shown in FIG. 1, with a headrest board in an open headrest position and a lumbar board in an open lumbar position.
Figure 4:
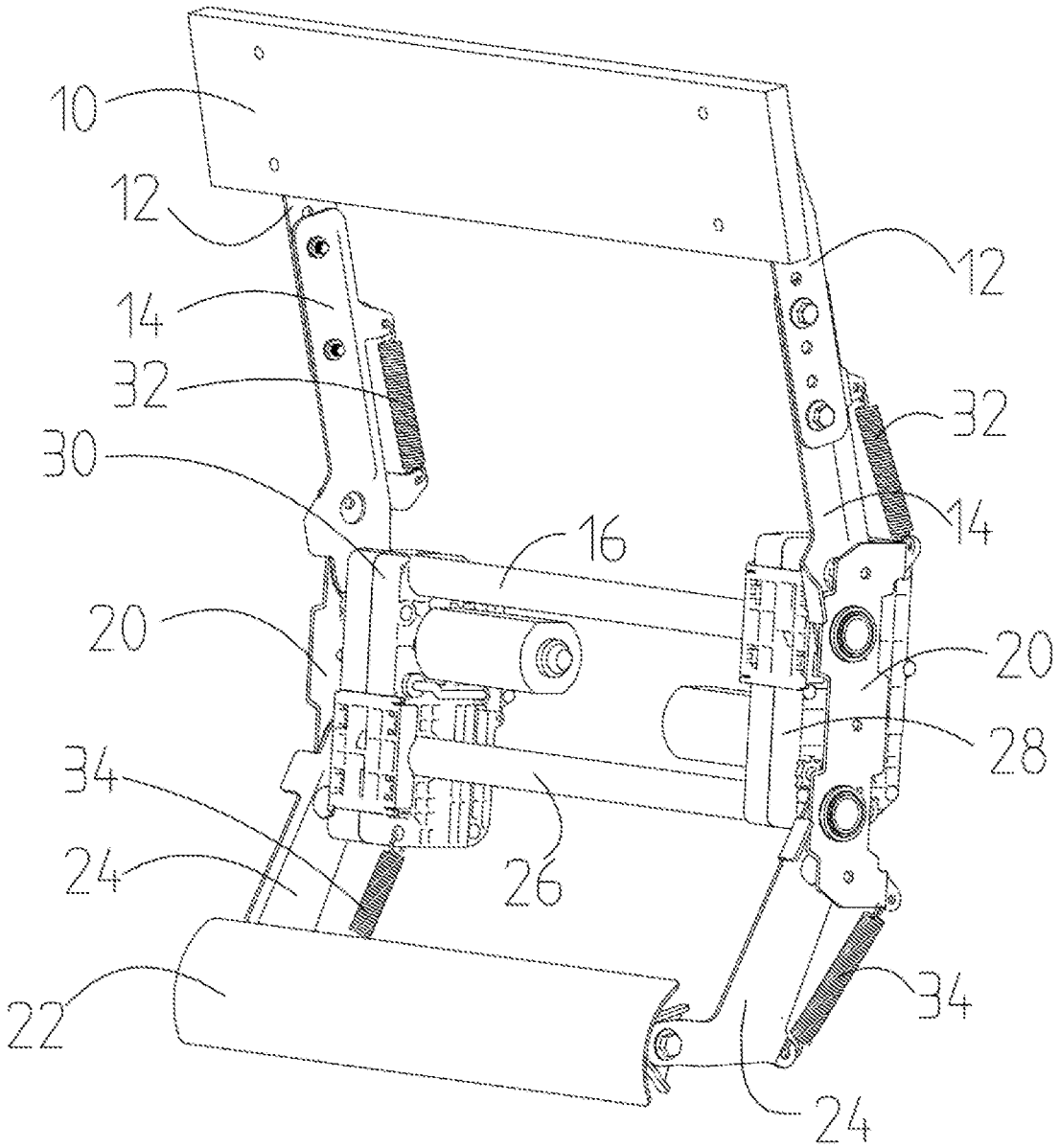
FIG. 4 shows schematically a perspective view of a power operation system with a power headrest operation system and a power lumbar operation system according to one embodiment of the invention.

Referring to FIGS. 1-3, a chair is shown according to one embodiment of the invention. In this exemplary embodiment, the chair has a back frame 70 and a power operation system. It should be noted that the chair has other parts (e.g. a seat, a number of legs, a number of arms) other than the back frame 70 and the power operation system. In this exemplary embodiment, the power operation system has a power headrest operation system and a power lumbar operation system. Both the power headrest operation system and the power lumbar operation system are coupled to the back frame 70, and the ways in which they are coupled will be detailed below. It should be noted that, in another embodiment, the power operation system may have a power headrest operation system without a power lumbar operation system (this embodiment is called a "single power headrest operation system"). Alternatively in yet another embodiment, the power operation system may have a power lumbar operation system without a power headrest operation system (this embodiment is called a "single power lumbar operation system").

Referring to FIGS. 4-10, the power headrest operation system includes a headrest board 10 with two headrest board end portions, a pair of headrest posts 12 each with two headrest post end portions, a pair of headrest support posts 14 each with two headrest support post end portions, a headrest axis of rotation 16 with two headrest rotation axis end portions, a first mounting bracket 20*a* and a second mounting bracket 20*b* (collectively, called a pair of mounting brackets 20), a headrest actuator 28, a pulling mechanism 32, and a stopping mechanism 38.

Generally, the headrest actuator 28 drives in two opposite directions: a headrest forward direction and a headrest backward direction. When the headrest actuator 28 drives in the headrest forward direction, the headrest actuator 28 rotates, through rotation of the headrest axis of rotation 16, the headrest board 10 from a closed headrest position to an open headrest position. On the other hand, when the headrest actuator 28 drives in the headrest backward direction, the pulling mechanism 32 pulls the headrest board 10 from the open headrest position to the closed headrest position, and the stopping mechanism 38 prevents the headrest board 10 from rotating any further once the headrest board 10 arrives at the closed headrest position. In this way, the headrest board 10 can be switched between the closed headrest position and the open headrest position, under the control of the headrest actuator 28, depending on the need of the user of the chair. Moreover, the pulling mechanism 32, rather than the headrest actuator 28, pulls the headrest board 10 from the open headrest position to the closed headrest position. Thus, the pulling force may be relatively small and the power headrest operation system is anti-pinch, both of which are desirable for safety.

More specifically, the headrest board 10 has two headrest board end portions. In this exemplary embodiment, the headrest board 10 is a rectangular board, and the two headrest board end portions are the two ends along the long sides of the rectangular board. It should be noted that the headrest board 10 may have other shapes other than rectangular.

Each of the pair of headrest posts 12 each has two headrest post end portions. Each headrest post 12 is connected, at one headrest post end portion, to one of the two headrest board end portions of the headrest board 10.

Each of the pair of headrest support posts 14 has two headrest support post end portions. Each headrest support post 14 is coupled, at one headrest support post end portion, to one of the pair of headrest posts 12 at the other headrest post end portion, respectively.

The headrest axis of rotation 16 has two headrest rotation axis end portions. The other headrest support post end portion of each of the pair of headrest support post 14 is welded on each of the two headrest rotation axis end portions, respectively.

In other words, on each side of the headrest board 10, there is one group of one headrest post 12 and one headrest support post 14 coupled with each other, respectively. Except this coupling, the headrest post 12 is connected to one of the two headrest board end portions of the headrest board 10, while the headrest support post 14 is welded on one of two headrest rotation axis end portions.

Figure 5:
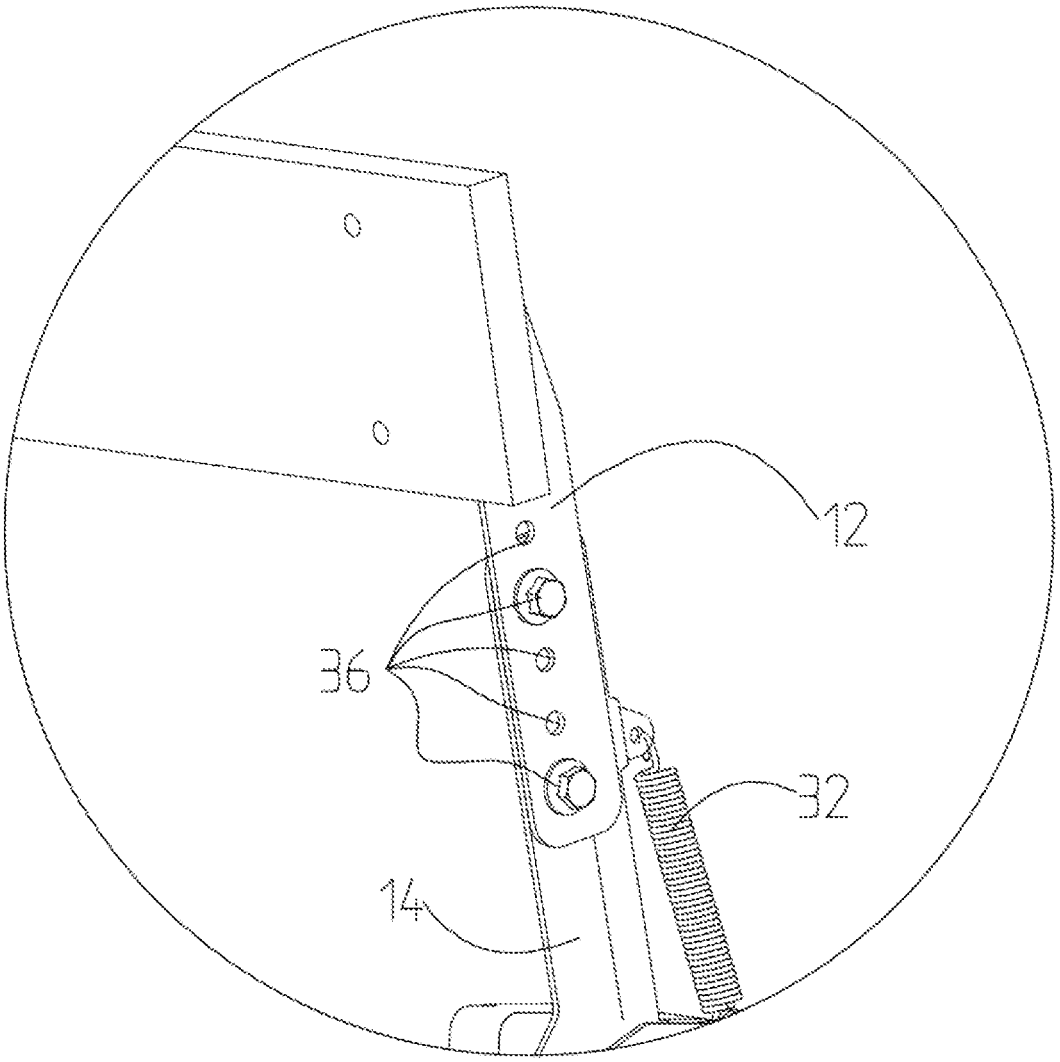
FIG. 5 shows schematically an enlarged perspective view of adjustable holes of the power operation system shown in FIG. 4.
Figure 6:
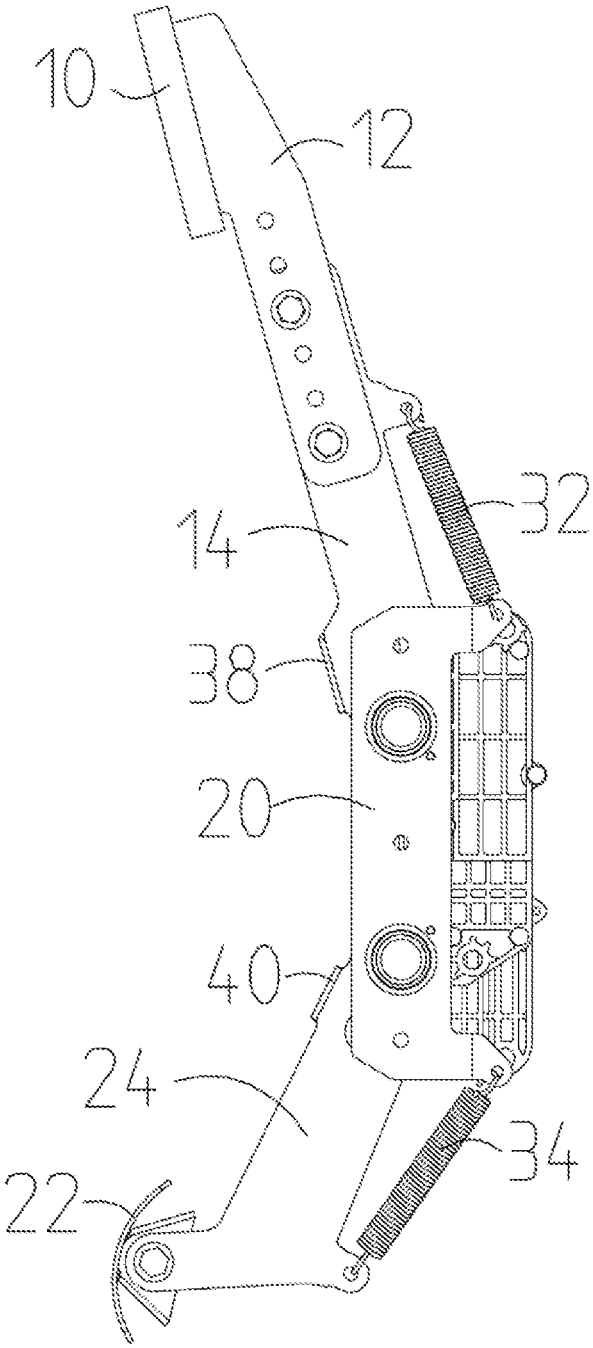
FIG. 6 shows a side-view of the power operation system shown in FIG. 4.
Figure 7:
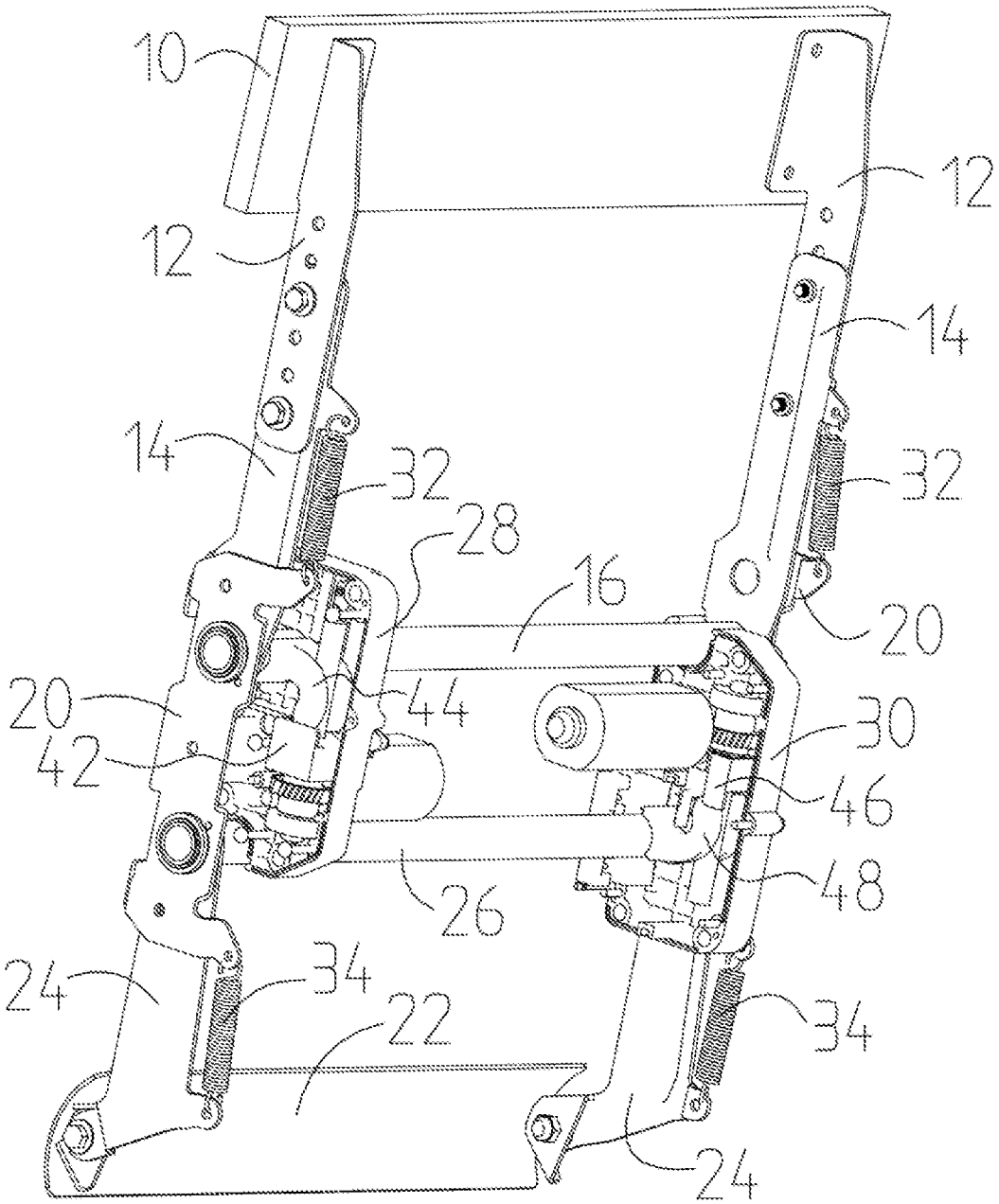
FIG. 7 shows schematically a back perspective view of the power operation system shown in FIG. 4.
Figure 8:
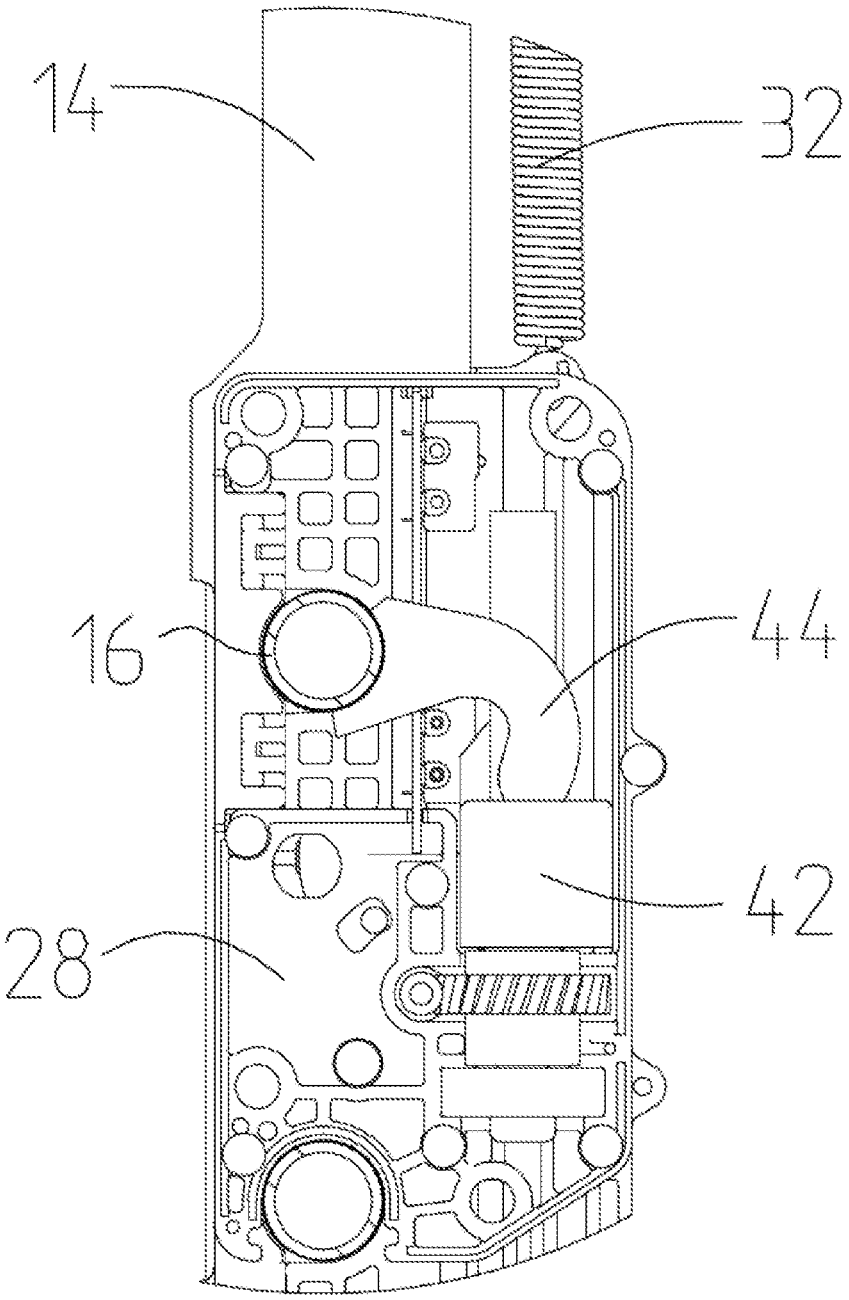
FIG. 8 shows schematically an enlarged side-view of a headrest actuator.
Figure 9:
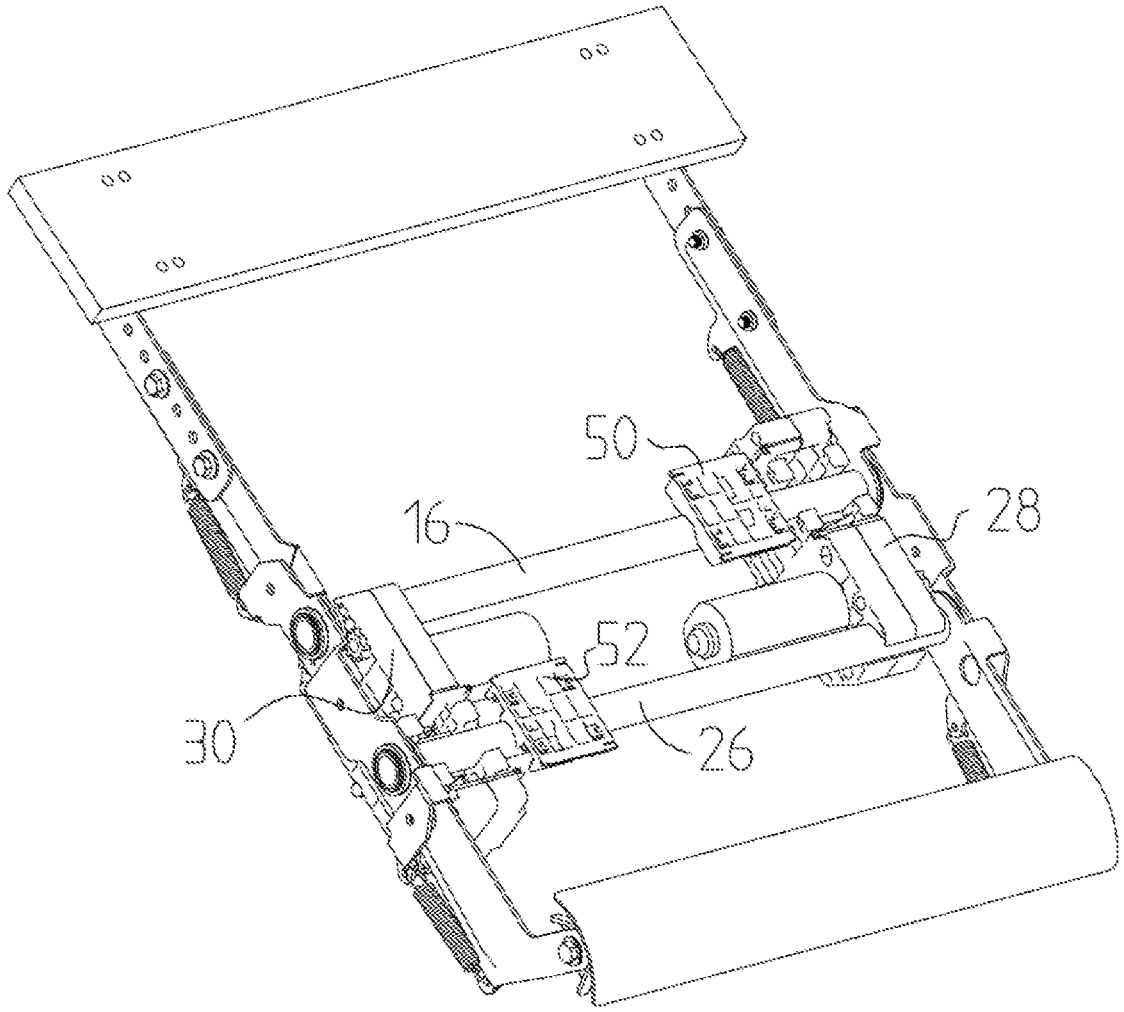
FIG. 9 shows schematically another perspective view of the power operation system shown in FIG. 4.
Figure 10:
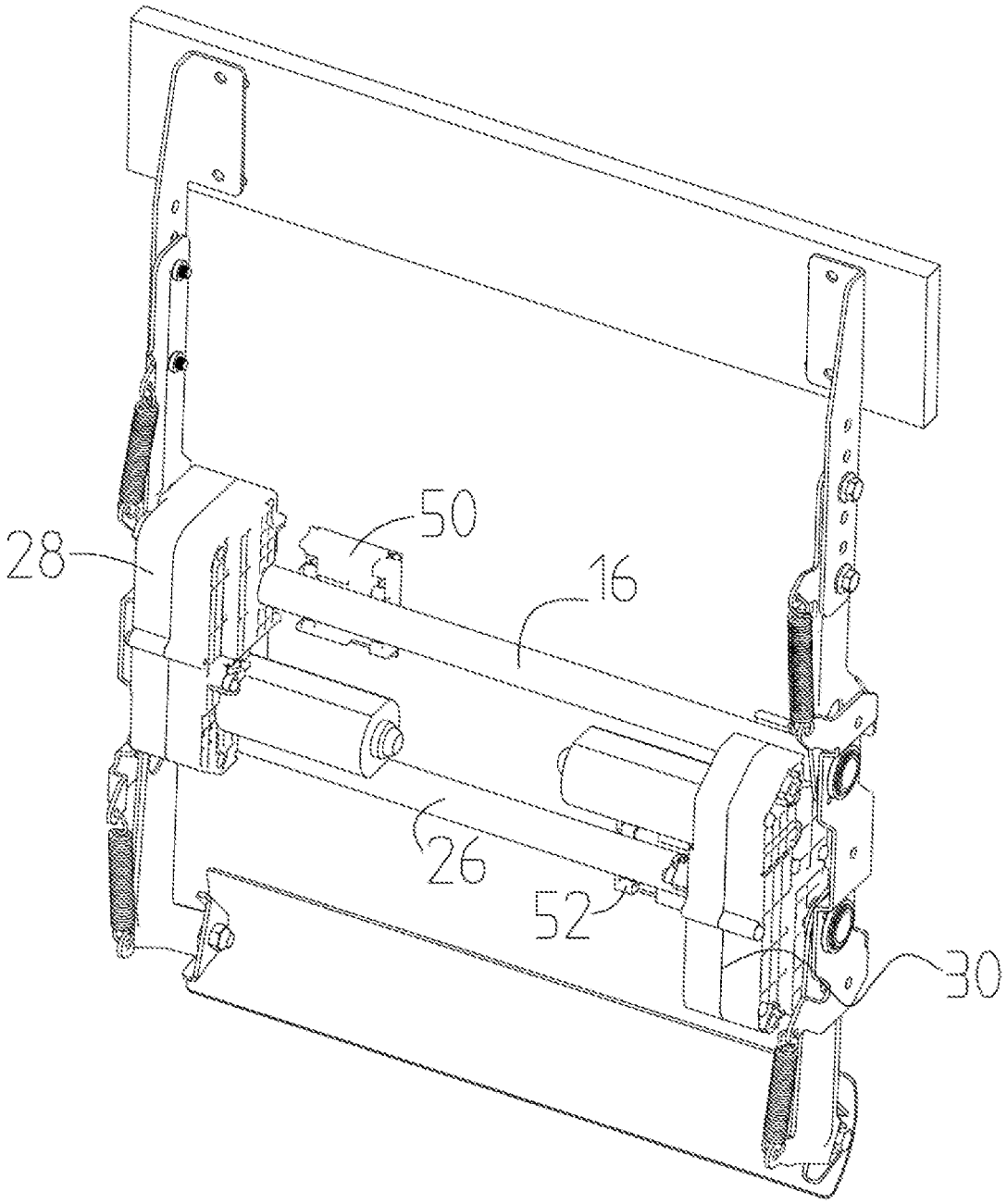
FIG. 10 shows schematically a back perspective view of the power operation system shown in FIG. 4.
Figure 11:
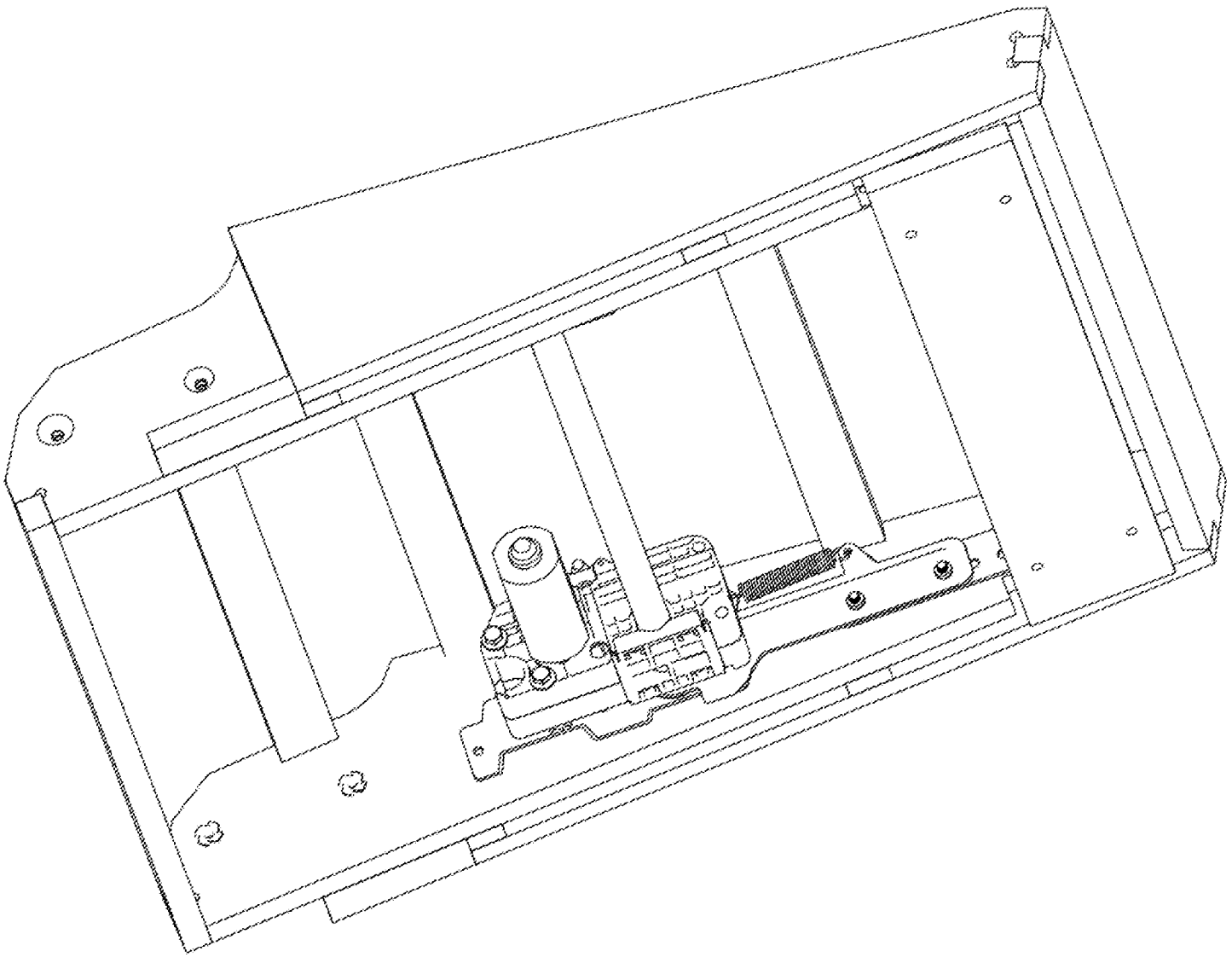
FIG. 11 shows schematically a perspective view of a chair with a power headrest operation system according to another embodiment of the invention.
Figure 12:
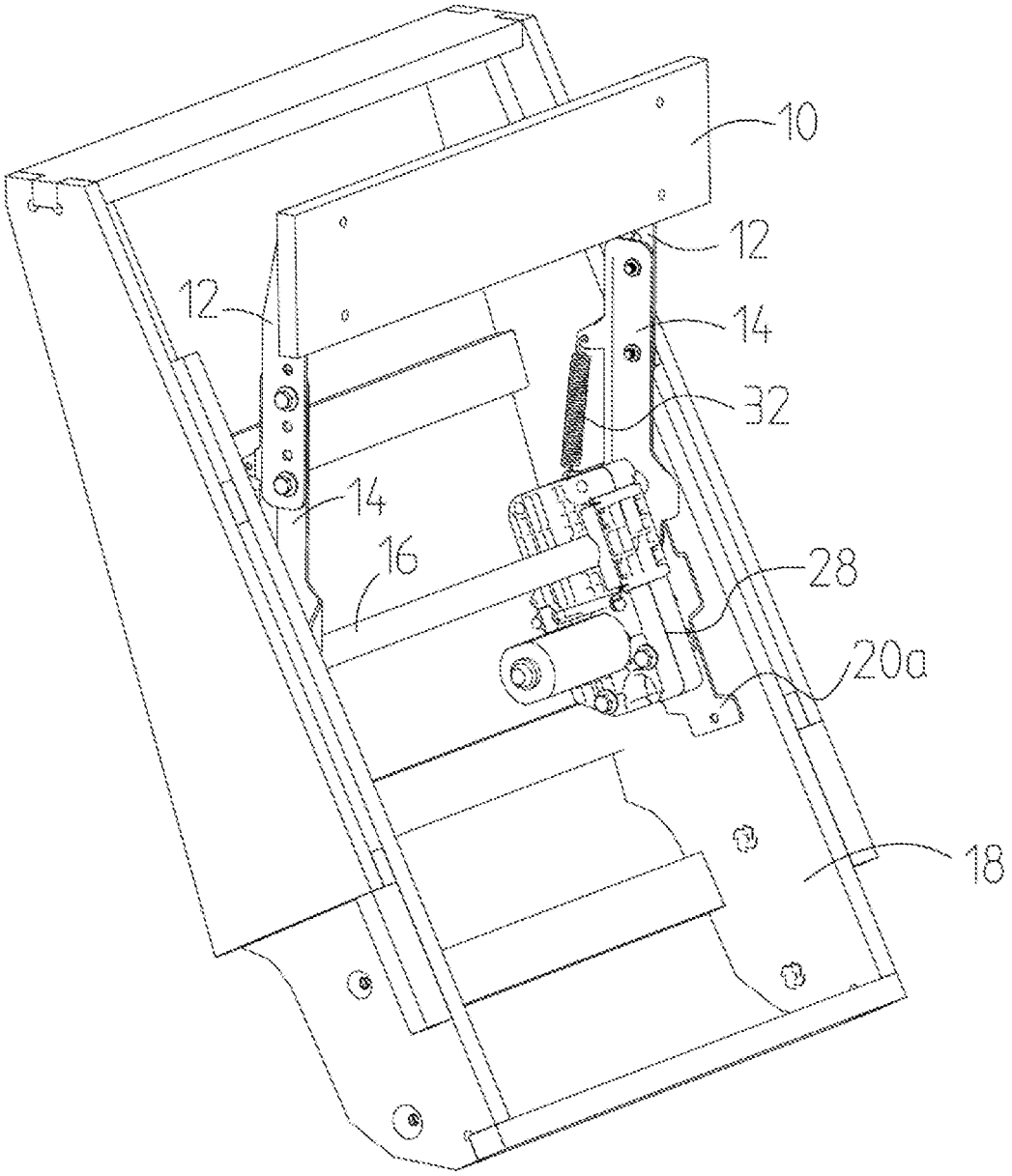
FIG. 12 shows schematically a perspective view of the chair shown in FIG. 11, with a headrest board in an open headrest position.
Figure 13:
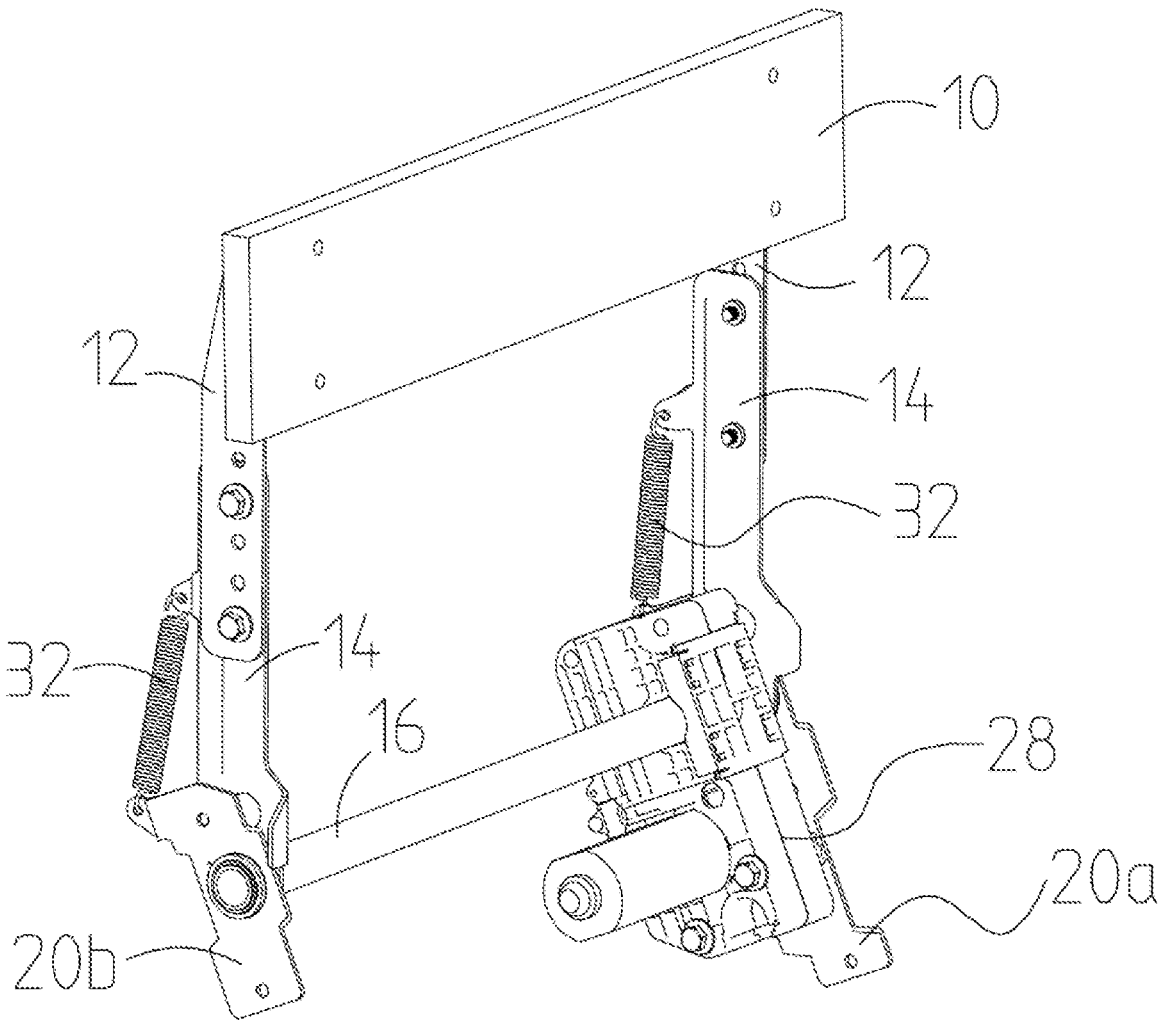
FIG. 13 shows schematically a perspective view of a power operation system with a power headrest operation system according to another embodiment of the invention.
Figure 14:
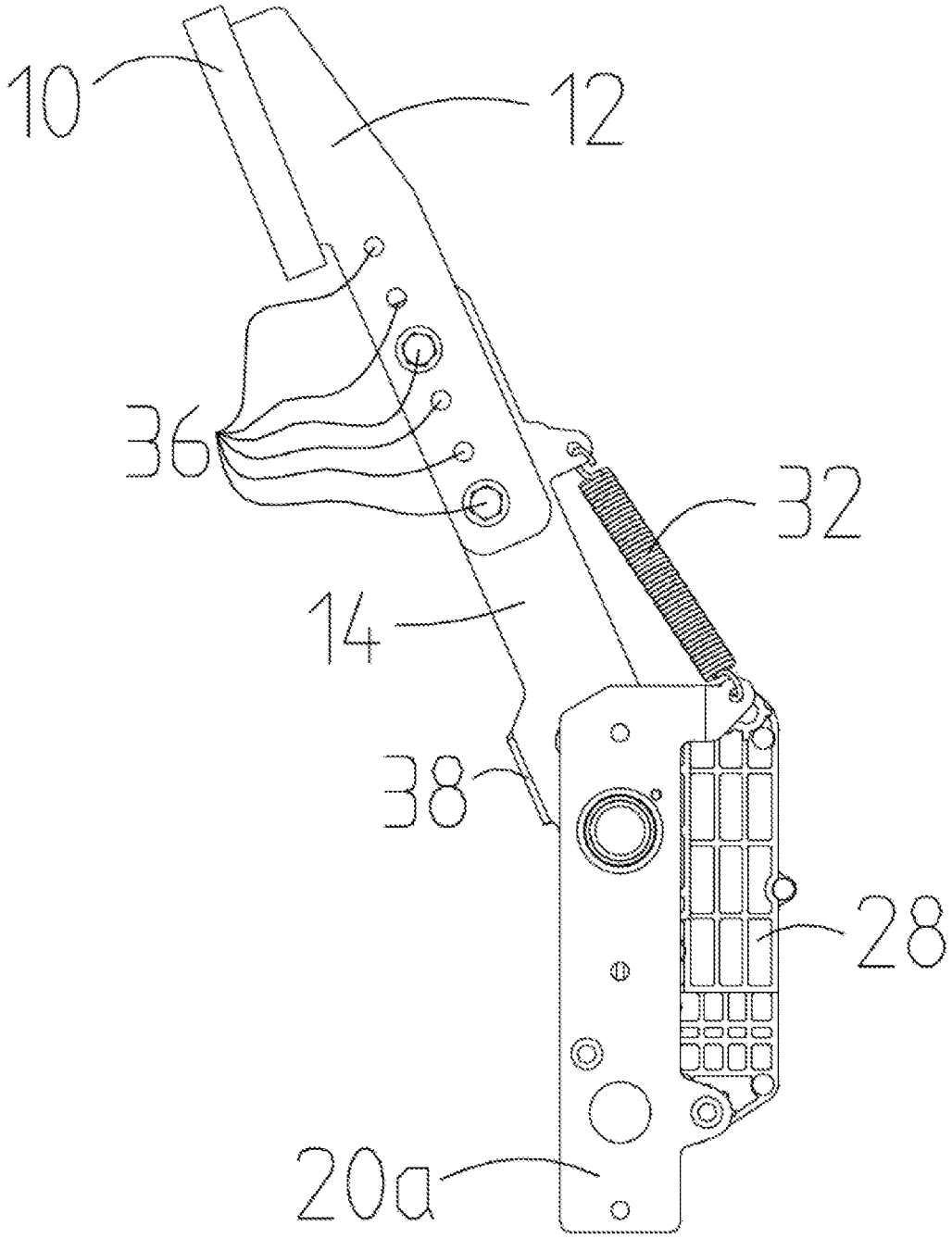
FIG. 14 shows a side-view of the power operation system shown in FIG. 13.

Referring to FIG. 5 specifically, each of the pair of headrest posts 12 has a plurality of adjustable holes, for adjusting a relative position between the pair of headrest posts 12 and the pair of headrest support posts 14. In the exemplary embodiment, after a relative position between the pair of headrest posts 12 and the pair of headrest support posts 14 is chosen by the user of the chair, the relative position may be fixed by screws and nuts. In this way, the user of the chair can adjust the height of the headrest board 10 as he wishes. For example, for tall users, the headrest board 10 is set relatively high. This can increase the comfort of the user while using the chair.

Referring to FIGS. 4-10, the first mounting bracket 20*a* and a second mounting bracket 20*b* are located on each side of the headrest axis of rotation 16. The headrest axis of rotation 16 is pivotally coupled to the back frame 70 of the chair through the first mounting bracket 20*a* and the second mounting bracket 20*b*. In other words, the first mounting bracket 20*a* and the second mounting bracket 20*b* are mounted on the back frame 70, and the headrest axis of rotation 16 can rotate with respect to the back frame 70, the first mounting bracket 20*a* and the second mounting bracket 20*b*.

The headrest actuator 28 has two headrest actuator end portions. One headrest actuator end portion is pivotally coupled to the headrest axis of rotation 16, while the other headrest actuator end portion is pivotally coupled to a lumbar axis of rotation 26. It should be noted that alternatively in a single power headrest operation system, the other headrest actuator end portion is coupled to the first mounting bracket 20*a*.

Referring to FIGS. 7-10 specifically, the headrest actuator 28 includes a spindle nut 42, a pressure lever 44 welded on the headrest axis of rotation 16, a headrest actuator housing holding the spindle nut 42 and the pressure lever 44, and a locking cap 50 snapped in the headrest actuator housing. When the headrest actuator 28 drives in the headrest forward direction, the spindle nut 42 pushes the pressure lever 44 welded on the headrest axis of rotation 16, to rotate the headrest axis of rotation 16. The rotation of the headrest axis of rotation 16 rotates the headrest board 10 from the closed headrest position to the open headrest position. The locking cap 50 and the headrest actuator housing together pivotally coupling one headrest actuator end portion to the headrest axis of rotation 16. In other words, after the locking cap 50 is snapped in the headrest actuator housing, the headrest axis of rotation 16 goes through the headrest actuator 28 at one headrest actuator end portion. This snap-in design makes the headrest actuator 28 easy to be installed or assembled without tools.

The pulling mechanism 32 has two pulling mechanism end portions. One pulling mechanism end portion is coupled to at least one of the first mounting bracket 20*a* and the second mounting bracket 20*b*, while the other pulling mechanism end portion is coupled to at least one of the pair of headrest support posts 14. In the exemplary embodiment, one example of the pulling mechanism 32 is a pair of springs 32. Each of the pair of springs 32 having two ends, one end is coupled to one of the pair of headrest support posts 14 respectively, while the other end is coupled to the first mounting bracket 20*a* and the second mounting bracket 20*b* respectively. In other words, on one side of the headrest axis of rotation 16, a spring 32 is coupled between a headrest support post 14 and the first mounting bracket 20*a*; while on the other side of the headrest axis of rotation 16, another spring 32 is coupled between another headrest support post 14 and the second mounting bracket 20*b*. It should be noted that pulling mechanisms other than the pair of springs 32 may be employed.

When the headrest actuator 28 drives in the headrest backward direction, the pulling mechanism 32 pulls the headrest board 10 from the open headrest position to the closed headrest position, the stopping mechanism 38 prevents the headrest board 10 from rotating any further once the headrest board 10 arrives at the closed headrest position. In other words, the stopping mechanism 38 defines the closed headrest position.

The stopping mechanism 38 is a pair of stopping taps 38. Each of the pair of stopping taps 38 is a protruding part of one of the pair of headrest support posts 14 respectively. The pair of stopping taps 38 contact the first mounting bracket 20*a* and the second mounting bracket 20*b* respectively when the headrest board 10 arrives at the closed headrest position. In other words, one stopping tap 38 is a protruding part of one headrest support post 14 and contacts the first mounting bracket 20*a* when the headrest board 10 arrives at the closed headrest position, while another stopping tap 38 is a protruding part of another headrest support post 14 and contacts the second mounting bracket 20*b* when the headrest board 10 arrives at the closed headrest position. It should be noted that stopping mechanisms other than the pair of stopping taps 38 may also be employed.

Similarly, referring to FIGS. 4-10, the power lumbar operation system includes a lumbar board 22 with two lumbar board end portions, a pair of lumbar support posts 24 each with two lumbar support post end portions, the lumbar axis of rotation 26 with two lumbar rotation axis end portions, a lumbar actuator 30, a pulling mechanism 34, and a stopping mechanism 40.

Generally, the lumbar actuator 30 drives in two opposite directions: a lumbar forward direction and a lumbar backward direction. When the lumbar actuator 30 drives in the lumbar forward direction, the lumbar actuator 30 rotates, through rotation of the lumbar axis of rotation 26, the lumbar board 22 from a closed lumbar position to an open lumbar position. On the other hand, when the lumbar actuator 30 drives in the lumbar backward direction, the pulling mechanism 34 pulls the lumbar board 22 from the open lumbar position to the closed lumbar position, and the stopping mechanism 40 prevents the lumbar board 22 from rotating any further once the lumbar board 22 arrives at the closed lumbar position. In this way, the lumbar board 22 can be switched between the closed lumbar position and the open lumbar position, under the control of the lumbar actuator 30, depending on the need of the user of the chair. Moreover, the pulling mechanism 34, rather than the lumbar actuator 30, pulls the lumbar board 22 from the open lumbar position to the closed lumbar position. Thus, the pulling force may be relatively small and the power lumbar operation system is anti-pinch, both of which are desirable for safety.

More specifically, the lumbar board 22 has two lumbar board end portions. In this exemplary embodiment, the lumbar board 22 is a curved rectangular board, and the two lumbar board end portions are the two ends along the long sides of the curved rectangular board. It should be noted that the lumbar board 22 may have other shapes other than curved rectangular.

Each of the pair of lumbar support posts 24 has two lumbar support post end portions. Each lumbar support post 24 is coupled, at one lumbar support post end portion, to one of the two lumbar board end portions of the lumbar board 22 respectively.

The lumbar axis of rotation 26 has two lumbar rotation axis end portions. The other lumbar support post end portion of each of the pair of lumbar support post 24 is welded on each of the two lumbar rotation axis end portions, respectively.

In other words, on each side of the lumbar board 22, there is one lumbar support post 24. The lumbar support post 24 is coupled, at one lumbar support post end portion, to one of the two lumbar board end portions of the lumbar board 22, while the other lumbar support post end portion is welded on one of the two lumbar rotation axis end portions.

The lumbar axis of rotation 26 is pivotally coupled to the back frame 70 of the chair through the first mounting bracket 20*a* and the second mounting bracket 20*b*. In other words, the first mounting bracket 20*a* and the second mounting bracket 20*b* are mounted on the back frame 70, and the lumbar axis of rotation 26 can rotate with respect to the back frame 70, the first mounting bracket 20*a* and the second mounting bracket 20*b*.

The lumbar actuator 30 has two lumbar actuator end portions. One lumbar actuator end portion is pivotally coupled to the lumbar axis of rotation 26, while the other lumbar actuator end portion is pivotally coupled to the headrest axis of rotation 16. It should be noted that alternatively in a single power lumbar operation system, the other lumbar actuator end portion is coupled to the second mounting bracket 20*b*.

Referring to FIGS. 7-10 specifically, the lumbar actuator 30 includes a spindle nut 46, a pressure lever 48 welded on the lumbar axis of rotation 26, a lumbar actuator housing holding the spindle nut 46 and the pressure lever 48, and a locking cap 52 snapped in the lumbar actuator housing. When the lumbar actuator 30 drives in the lumbar forward direction, the spindle nut 46 pushes the pressure lever 48 welded on the lumbar axis of rotation 26, to rotate the lumbar axis of rotation 26. The rotation of the lumbar axis of rotation 26 rotates the lumbar board 22 from the closed lumbar position to the open lumbar position. The first locking cap 52 and the lumbar actuator housing together pivotally coupling one lumbar actuator end portion to the lumbar axis of rotation 26. In other words, after the locking cap 52 is snapped in the lumbar actuator housing, the lumbar axis of rotation 26 goes through the lumbar actuator 30 at one lumbar actuator end portion. This snap-in design makes the headrest actuator 28 easy to be installed or assembled without tools.

The pulling mechanism 34 has two pulling mechanism end portions. One pulling mechanism end portion is coupled to at least one of the first mounting bracket 20*a* and the second mounting bracket 20*b*, while the other pulling mechanism end portion is coupled to at least one of the pair of lumbar support posts 24. In the exemplary embodiment, one example of the pulling mechanism 34 is a pair of springs 34. Each of the pair of springs 34 having two ends, one end is coupled to one of the pair of lumbar support posts 24 respectively, while the other end is coupled to the first mounting bracket 20*a* and the second mounting bracket 20*b* respectively. In other words, on one side of the lumbar axis of rotation 26, a spring 34 is coupled between a lumbar support post 24 and the first mounting bracket 20*a*; while on the other side of the lumbar axis of rotation 26, another spring 34 is coupled between another lumbar support post 24 and the second mounting bracket 20*b*. It should be noted that pulling mechanisms other than the pair of springs 34 may be employed.

When the lumbar actuator 30 drives in the lumbar backward direction, the pulling mechanism 34 pulls the lumbar board 22 from the open lumbar position to the closed headrest position, the stopping mechanism 40 prevents the lumbar board 22 from rotating any further once the lumbar board 22 arrives at the closed headrest position. In other words, the stopping mechanism 40 defines the closed lumbar position.

The stopping mechanism 40 is a pair of stopping taps 40. Each of the pair of stopping taps 40 is a protruding part of one of the pair of lumbar support posts 24 respectively. The pair of stopping taps 40 contact the first mounting bracket 20*a* and the second mounting bracket 20*b* respectively when the lumbar board 22 arrives at the closed lumbar position. In other words, one stopping tap 40 is a protruding part of one lumbar support post 24 and contacts the first mounting bracket 20*a* when the lumbar board 22 arrives at the closed lumbar position, while another stopping tap 40 is a protruding part of another lumbar support post 24 and contacts the second mounting bracket 20*b* when the lumbar board 22 arrives at the closed lumbar position. It should be noted that stopping mechanisms other than the pair of stopping taps 40 may also be employed.

Referring to FIGS. 11-15, a chair is shown according to another embodiment of the invention. Generally, the chair in this embodiment of the invention is the same as the chair in the previous embodiment of the invention (i.e., the embodiment where the chair has both a power headrest operation system and a lumbar headrest operation system shown in FIGS. 1-10), except that the power operation system does not have a power lumbar operation system. In other words, the power operation system only has a power headrest operation system. Therefore, a user can choose between either a chair with a power lumbar operation system or a chair without a power lumbar operation system, depending on his own needs.

Figure 15:
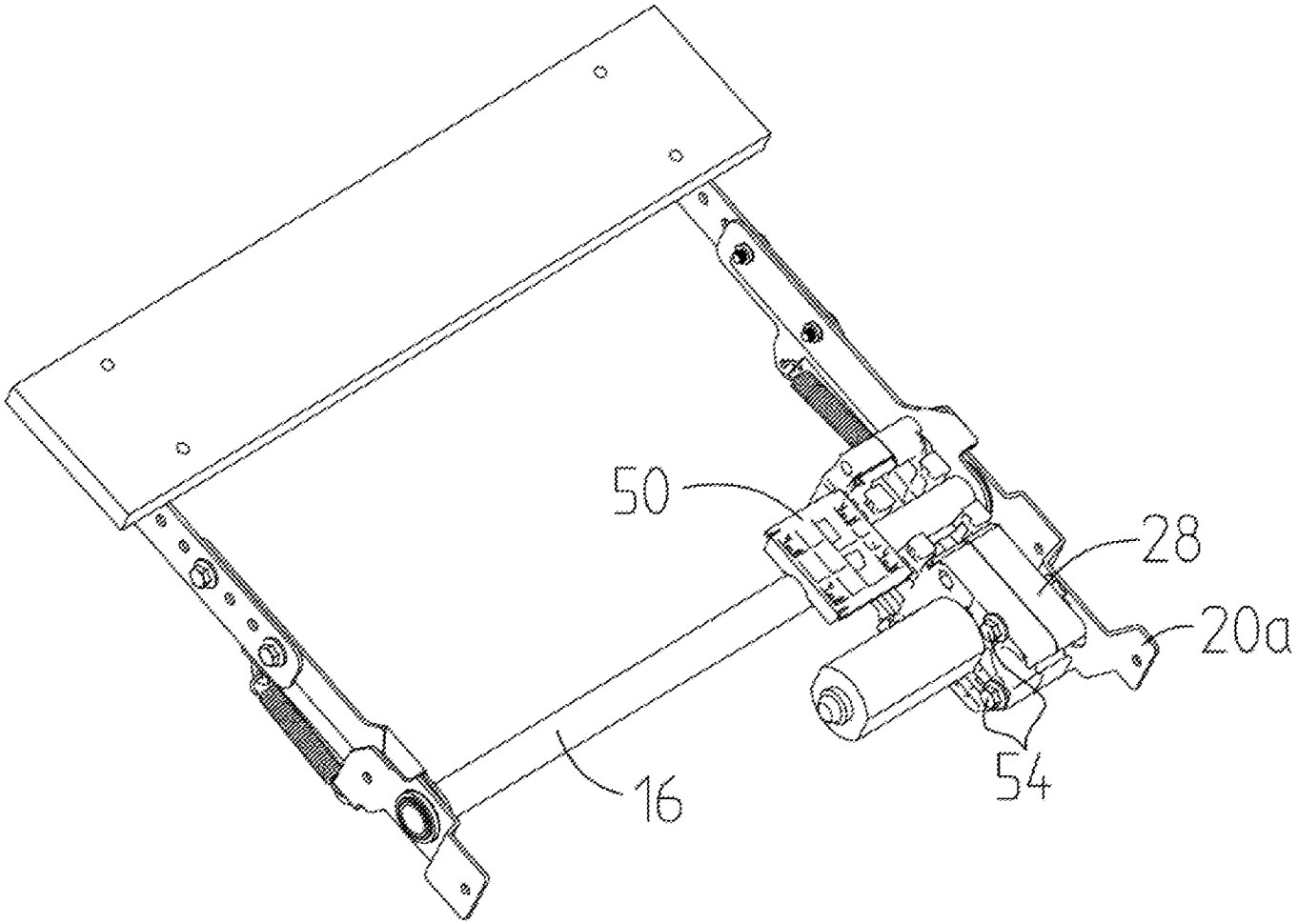
FIG. 15 shows schematically another perspective view of the power operation system shown in FIG. 13.

Referring to FIG. 15 specifically, the headrest actuator 28 has two headrest actuator end portions. One headrest actuator end portion is pivotally coupled to the headrest axis of rotation 16. The locking cap 50 and the headrest actuator housing together pivotally coupling one headrest actuator end portion to the headrest axis of rotation 16. In other words, after the locking cap 50 is snapped in the headrest actuator housing, the headrest axis of rotation 16 goes through the headrest actuator 28 at one headrest actuator end portion. This snap-in design makes the headrest actuator 28 easy to be installed or assembled without tools. The other headrest actuator end portion may be coupled to the first mounting bracket 20*a* by self-tapping bolts 54. Alternatively, the other headrest actuator end portion may be pivotally coupled to another axle, just like the lumbar axis of rotation 26 in the previous embodiment of the invention (i.e., the embodiment where the chair has both a power headrest operation system and a lumbar headrest operation system shown in FIGS. 1-10).

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A power operation system used in a chair, comprising a power headrest operation system, the power headrest operation system comprising:

(a) a headrest board with two headrest board end portions;

(b) a pair of headrest posts each with two headrest post end portions, each headrest post connected, at one headrest post end portion, to one of the two headrest board end portions of the headrest board respectively;

(c) a pair of headrest support posts each with two headrest support post end portions, each headrest support post coupled, at one headrest support post end portion, to one of the pair of headrest posts respectively;

(d) a headrest axis of rotation shaft with two headrest rotation axis end portions, the other headrest support post end portion of each of the pair of headrest support post welded on each of the two headrest rotation axis end portions respectively;

(e) a first mounting bracket and a second mounting bracket, the headrest axis of rotation shaft pivotally coupled to a back frame of the chair through the first mounting bracket and the second mounting bracket;

(f) a headrest actuator, the headrest actuator having two headrest actuator end portions, one headrest actuator end portion pivotally coupled to the headrest axis of rotation shaft, the other headrest actuator end portion coupled to the first mounting bracket or pivotally coupled to a lumbar axis of rotation shaft, the headrest actuator driving in a headrest forward direction and a headrest backward direction;

(g) a first pulling mechanism, coupled to at least one of the first mounting bracket and the second mounting bracket, and coupled to at least one of the pair of headrest support posts; and (h) a first stopping mechanism;

wherein when the headrest actuator drives in the headrest forward direction, the headrest actuator rotates, through rotation of the headrest axis of rotation shaft, the headrest board from a closed headrest position to an open headrest position;

when the headrest actuator drives in the headrest backward direction, the first pulling mechanism pulls the headrest board from the open headrest position to the closed headrest position, the first stopping mechanism prevents the headrest board from rotating any further once the headrest board arrives at the closed headrest position;

wherein the headrest actuator comprises:

a first spindle nut; and a first pressure lever, welded on the headrest axis of rotation shaft;

wherein when the headrest actuator drives in the headrest forward direction, the first spindle nut moves to push the first pressure lever, to rotate, through rotation of the headrest axis of rotation shaft, the headrest board from the closed headrest position to the open headrest position; and wherein the headrest actuator further comprises:

a headrest actuator housing holding the first spindle nut and the first pressure lever; and a first locking cap, snapped in the headrest actuator housing, the first locking cap and the headrest actuator housing together enclosing the headrest actuator including the first spindle nut and the first pressure lever and pivotally coupling one headrest actuator end portion to the headrest axis of rotation shaft.

2. The power operation system of claim 1, wherein the first pulling mechanism is a first pair of springs, each of the first pair of springs having two ends, one end coupled to one of the pair of headrest support posts respectively, the other end coupled to the first mounting bracket and the second mounting bracket respectively.

3. The power operation system of claim 1, wherein the first stopping mechanism is a first pair of stopping taps, each of the first pair of stopping taps is a protruding part of one of the pair of headrest support posts respectively, contacting the first mounting bracket and the second mounting bracket respectively when the headrest board arrives at the closed headrest position.

4. The power operation system of claim 1, wherein each of the pair of headrest posts has a plurality of adjustable holes, for adjusting a relative position between each of the pair of headrest posts and each of the pair of headrest support posts.

5. The power operation system of claim 1, further comprising a power lumbar operation system, the power lumbar operation system comprising:

(i) a lumbar board with two lumbar board end portions;

(j) a pair of lumbar support posts each with two lumbar support post end portions, each lumbar support post connected, at one lumbar support post end portion, to one of the two lumbar board end portions of the lumbar board respectively;

(k) the lumbar axis of rotation shaft with two lumbar rotation axis end portions, the other lumbar support post end portion of each of the pair of lumbar support post welded on each of the two lumbar rotation axis end portions respectively, the lumbar axis of rotation shaft pivotally coupled to the back frame of the chair through the first mounting bracket and the second mounting bracket;

(l) a lumbar actuator, the lumbar actuator having two lumbar actuator end portions, one lumbar actuator end portion pivotally coupled to the lumbar axis of rotation shaft, the other lumbar actuator end portion coupled to the second mounting bracket or pivotally coupled to the headrest axis of rotation shaft, the lumbar actuator driving in a lumbar forward direction and a lumbar backward direction;

(m) a second pulling mechanism, coupled to at least one of the first mounting bracket and the second mounting bracket, and coupled to at least one of the pair of lumbar support posts; and (n) a second stopping mechanism;

wherein when the lumbar actuator drives in the lumbar forward direction, the lumbar actuator rotates, through rotation of the lumbar axis of rotation shaft, the lumbar board from a closed lumbar position to an open lumbar position; and when the lumbar actuator drives in the lumbar backward direction, the second pulling mechanism pulls the lumbar board from the open lumbar position to the closed lumbar position, the second stopping mechanism prevents the lumbar board from rotating any further once the lumbar board arrives at the closed lumbar position.

6. The power operation system of claim 5, wherein the lumbar actuator comprises:

a second spindle nut; and a second pressure lever, welded on the lumbar axis of rotation shaft;

wherein when the lumbar actuator drives in the lumbar forward direction, the second spindle nut moves forward to push the second pressure lever, to rotate, through rotation of the lumbar axis of rotation shaft, the lumbar board from the closed lumbar position to the open lumbar position.

7. The power operation system of claim 6, wherein the lumbar actuator further comprises:

a lumbar actuator housing holding the second spindle nut and the second pressure lever; and a second locking cap, snapped in the lumbar actuator housing, the second locking cap and the lumbar actuator housing together pivotally coupling one lumbar actuator end portion to the lumbar axis of rotation shaft.

8. The power operation system of claim 5, wherein the second pulling mechanism is a second pair of springs, each of the second pair of springs having two ends, one end coupled to one of the pair of lumbar support posts respectively, the other end coupled to the first mounting bracket and the second mounting bracket respectively.

9. The power operation system of claim 5, wherein the second stopping mechanism is a second pair of stopping taps, each of the second pair of stopping taps is a protruding part of one of the pair of lumbar support posts respectively, contacting the first mounting bracket and the second mounting bracket respectively when the lumbar board arrives at the closed lumbar position.

10. A chair, comprising:

a back frame; and a power operation system used in the chair, comprising a power headrest operation system, the power headrest operation system comprising:

(a) a headrest board with two headrest board end portions;

(b) a pair of headrest posts each with two headrest post end portions, each headrest post connected, at one headrest post end portion, to one of the two headrest board end portions of the headrest board respectively;

(c) a pair of headrest support posts each with two headrest support post end portions, each headrest support post coupled, at one headrest support post end portion, to one of the pair of headrest posts respectively;

(d) a headrest axis of rotation shaft with two headrest rotation axis end portions, the other headrest support post end portion of each of the pair of headrest support post welded on each of the two headrest rotation axis end portions respectively;

(e) a first mounting bracket and a second mounting bracket, the headrest axis of rotation shaft pivotally coupled to the back frame of the chair through the first mounting bracket and the second mounting bracket;

(f) a headrest actuator, the headrest actuator having two headrest actuator end portions, one headrest actuator end portion pivotally coupled to the headrest axis of rotation shaft, the other headrest actuator end portion coupled to the first mounting bracket or pivotally coupled to a lumbar axis of rotation shaft, the headrest actuator driving in a headrest forward direction and a headrest backward direction;

(g) a first pulling mechanism, coupled to at least one of the first mounting bracket and the second mounting bracket, and coupled to at least one of the pair of headrest support posts; and (h) a first stopping mechanism;

wherein when the headrest actuator drives in the headrest forward direction, the headrest actuator rotates, through rotation of the headrest axis of rotation shaft, the headrest board from a closed headrest position to an open headrest position; and when the headrest actuator drives in the headrest backward direction, the first pulling mechanism pulls the headrest board from the open headrest position to the closed headrest position, the first stopping mechanism prevents the headrest board from rotating any further once the headrest board arrives at the closed headrest position;

wherein the headrest actuator comprises:

a first spindle nut;

a first pressure lever, welded on the headrest axis of rotation shaft; a headrest actuator housing holding the first spindle nut and the first pressure lever; and a first locking cap, snapped in the headrest actuator housing, the first locking cap and the headrest actuator housing together enclosing the headrest actuator including the first spindle nut and the first pressure lever and pivotally coupling one headrest actuator end portion to the headrest axis of rotation shaft;

wherein when the headrest actuator drives in the headrest forward direction, the first spindle nut moves to push the first pressure lever, to rotate, through rotation of the headrest axis of rotation shaft, the headrest board from the closed headrest position to the open headrest position.

11. The chair of claim 10, wherein the first pulling mechanism is a first pair of springs, each of the first pair of springs having two ends, one end coupled to one of the pair of headrest support posts respectively, the other end coupled to the first mounting bracket and the second mounting bracket respectively.

12. The chair of claim 10, wherein the first stopping mechanism is a first pair of stopping taps, each of the first pair of stopping taps is a protruding part of one of the pair of headrest support posts respectively, contacting the first mounting bracket and the second mounting bracket respectively when the headrest board arrives at the closed headrest position.

13. The chair of claim 10, wherein each of the pair of headrest posts has a plurality of adjustable holes, for adjusting a relative position between each of the pair of headrest posts and each of the pair of headrest support posts.

14. The chair of claim 10, wherein the power operation system further comprising a power lumbar operation system, the power lumbar operation system comprising:

(i) a lumbar board with two lumbar board end portions;

(j) a pair of lumbar support posts each with two lumbar support post end portions, each lumbar support post connected, at one lumbar support post end portion, to one of the two lumbar board end portions of the lumbar board respectively;

(k) the lumbar axis of rotation shaft with two lumbar rotation axis end portions, the other lumbar support post end portion of each of the pair of lumbar support post welded on each of the two lumbar rotation axis end portions respectively, the lumbar axis of rotation shaft pivotally coupled to the back frame of the chair through the first mounting bracket and the second mounting bracket;

(l) a lumbar actuator, the lumbar actuator having two lumbar actuator end portions, one lumbar actuator end portion pivotally coupled to the lumbar axis of rotation shaft, the other lumbar actuator end portion coupled to the second mounting bracket or pivotally coupled to the headrest axis of rotation shaft, the lumbar actuator driving in a lumbar forward direction and a lumbar backward direction;

(m) a second pulling mechanism, coupled to at least one of the first mounting bracket and the second mounting bracket, and coupled to at least one of the pair of lumbar support posts; and (n) a second stopping mechanism;

wherein when the lumbar actuator drives in the lumbar forward direction, the lumbar actuator rotates, through rotation of the lumbar axis of rotation shaft, the lumbar board from a closed lumbar position to an open lumbar position; and when the lumbar actuator drives in the lumbar backward direction, the second pulling mechanism pulls the lumbar board from the open lumbar position to the closed lumbar position, the second stopping mechanism prevents the lumbar board from rotating any further once the lumbar board arrives at the closed lumbar position.

15. The chair of claim 14, wherein the lumbar actuator comprises:

a second spindle nut;

a second pressure lever, welded on the lumbar axis of rotation shaft;

a lumbar actuator housing holding the second spindle nut and the second pressure lever; and a second locking cap, snapped in the lumbar actuator housing, the second locking cap and the lumbar actuator housing together pivotally coupling one lumbar actuator end portion to the lumbar axis of rotation shaft;

wherein when the lumbar actuator drives in the lumbar forward direction, the second spindle nut moves forward to push the second pressure lever, to rotate, through rotation of the lumbar axis of rotation shaft, the lumbar board from the closed lumbar position to the open lumbar position.

16. The chair of claim 14, wherein the second pulling mechanism is a second pair of springs, each of the second pair of springs having two ends, one end coupled to one of the pair of lumbar support posts respectively, the other end coupled to the first mounting bracket and the second mounting bracket respectively.

17. The chair of claim 14, wherein the second stopping mechanism is a second pair of stopping taps, each of the second pair of stopping taps is a protruding part of one of the pair of lumbar support posts respectively, contacting the first mounting bracket and the second mounting bracket respectively when the lumbar board arrives at the closed lumbar position.

* * * * *